United States Patent [19]

Cook et al.

[11] Patent Number: 4,703,737

[45] Date of Patent: Nov. 3, 1987

[54] VAPOR CONTROL VALVE AND SYSTEM THEREFOR

[75] Inventors: John E. Cook, Chatham; Douglas G. Ciphery, Blenheim, both of Canada

[73] Assignee: Bendix Electronics Limited, Chatham, Canada

[21] Appl. No.: 892,540

[22] Filed: Jul. 31, 1986

[51] Int. Cl.[4] ..... F02M 37/20

[52] U.S. Cl. ..... 123/520; 123/518; 251/129.01; 251/129.21

[58] Field of Search ..... 123/520, 519, 518; 251/129.01, 129.21

[56] References Cited

U.S. PATENT DOCUMENTS

| | | | |
|---|---|---|---|
| 946,215 | 1/1910 | Geissinger | 251/129.01 |
| 3,043,336 | 7/1962 | Parent | 251/129.21 |
| 3,172,637 | 3/1965 | Adams | 251/129.21 |
| 3,521,851 | 7/1970 | Sorrow | 251/129.21 |
| 3,550,632 | 12/1970 | Noakes | 251/129.21 |
| 3,842,860 | 10/1974 | Stampfli | 251/129.01 |
| 4,175,526 | 11/1979 | Phelan | 123/520 |
| 4,432,328 | 2/1984 | Shimizu | 123/520 |

FOREIGN PATENT DOCUMENTS

| | | | |
|---|---|---|---|
| 59-176456 | 5/1984 | Japan | 123/520 |

*Primary Examiner*—Ronald B. Cox

*Attorney, Agent, or Firm*—Markell Seitzman; Russel C. Wells

[57] ABSTRACT

A vapor control valve (12) and system therefor for controlling fuel tank (14) pressure and for purging hydrocarbons from a storage canister (16) comprising a single electrical coil (44) responsive to control signals, wound about a carrier or bobbin (34) including a central passage (36) and means for dividing said central passage into first (40) and second (42) axially aligned portions; a first piston (60) slidably received within said central passage at said first portion (40); a second piston (80) slidably received within said central passage at said first portion (42); a first valve seat (132) for receiving said first piston; a second valve seat (106) for receiving said second piston, a first spring (66) for biasing said first piston into said first valve seat; a second spring (90) for biasing said second piston into said second valve seat, wherein the spring constant of said first spring is less than the spring constant of said second spring.

11 Claims, 2 Drawing Figures

VAPOR CONTROL VALVE AND SYSTEM THEREFOR

BACKGROUND AND SUMMARY OF THE INVENTION

The present invention is generally related to solenoid valves having a single stator and a plurality of axially oriented armatures and more specifically to a vapor control valve which controls the rate at which hydrocarbons, stored in a canister, are permitted to re-enter the intake manifold of an engine. Prior evaporative emission systems have not been able to allow the transfer of vapors from the tank to the canister during refueling and then seal up this passageway after a pre-determined time interval. Doing this will eliminate fuel expulsion on cap removal and at the same time maintain evaporative emissions within acceptable limits.

As part of the vapor emission control system of an automotive engine a carbon canister is utilized to absorb the hydrocarbon (gas) vapors within the fuel tank thereby permitting same from reaching the atmosphere and to thereafter, once the engine is started, return at a predetermined rate such hydrocarbons to the intake manifold of the engine where these hydrocarbons are combusted.

An advantage of the present invention is to incorporate within a single device means for controlling the fuel tank pressure as well as the rate at which the engine purges the vapors stored in the carbon canister.

The present invention replaces the plurality of such valves which find use in present day automotive systems. The present invention offers improved emissions performance while at the same time reduces the risk of fuel "spit back" which can occur under certain conditions when refueling.

Fuel "spit-back" refers to the expulsion from the fuel tank filler neck of droplets of fuel. It can occur either on fuel cap removal or during the process of refueling. In either case, it usually only occurs when the fuel tank is close to being full.

Accordingly, the invention comprises a vapor control valve and system for controlling fuel take pressure and for purging hydrocarbons from a storage canister comprising a single electrical coil, responsive to control signals, wound about a carrier or bobbin including a central passage therein divided into first and second axially aligned portions; a first piston slidable received within the central passage at the first portion; a second piston slidably received within the central passage at the first portion; a first valve seat for receiving the first piston; a second valve seat for receiving the second piston, a first spring for biasing the first piston into the first valve seat; and a second spring for biasing the second piston into the second valve seat, wherein the spring constant of the first spring is less than the spring constant of the second spring.

Many other objects, purposes and advantages of the invention will be clear from the following detailed description of the drawings.

BRIEF DESCRIPTIONS OF THE DRAWINGS

DETAILED DESCRIPTION OF THE DRAWINGS

Figure 1:
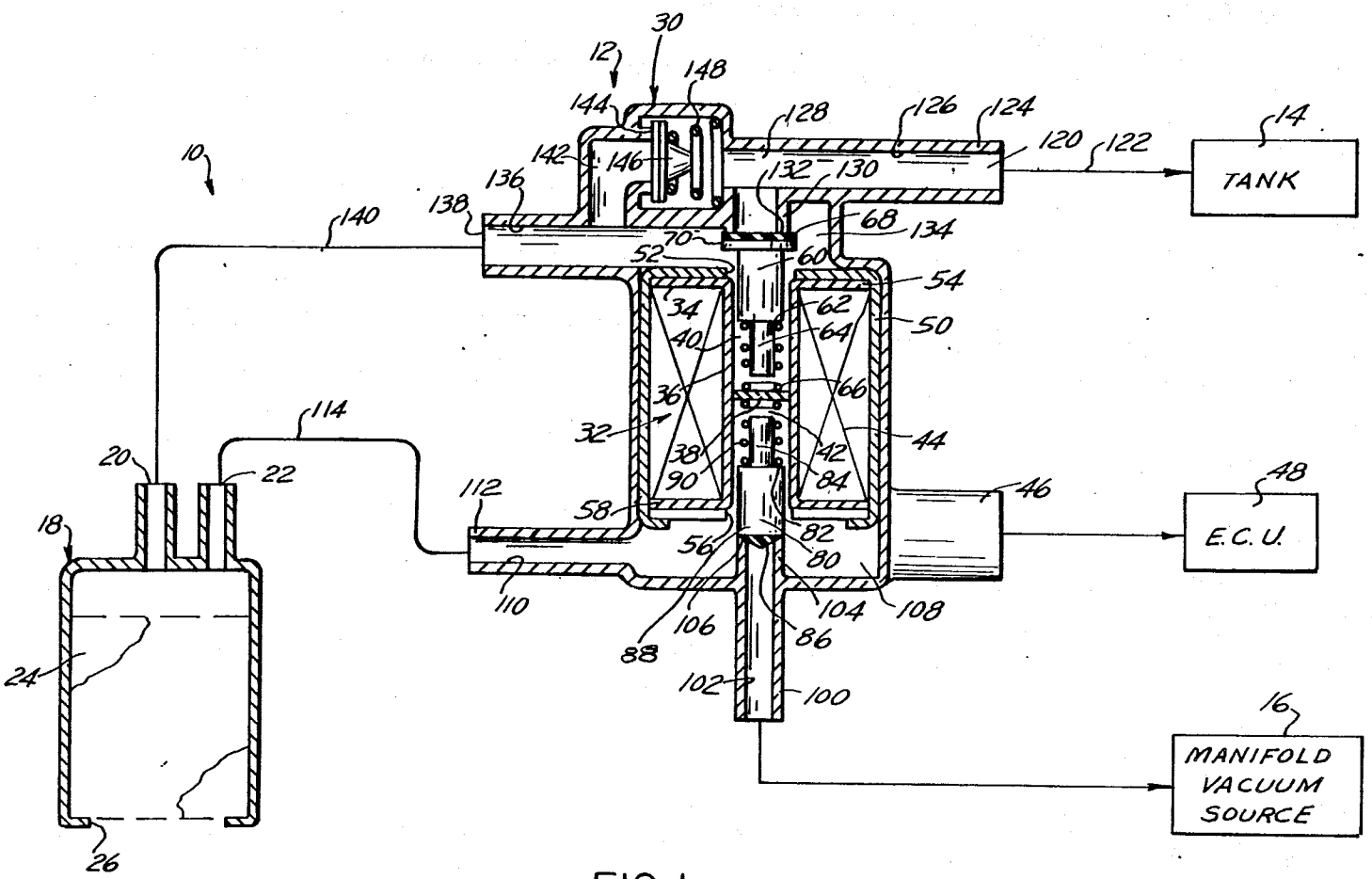
FIG. 1 shows a schematic view of a vapor control system employing the present invention.

FIG. 1 illustrates a diagramatic representation of a vapor control system 10 comprising an electrically actuated solenoid valve 12 which is communicated to a fuel tank 14, a source of vacuum pressure such as the intake manifold 16 of an engine and a hydrocarbon canister 18. The canister 18 is of a known construction comprising a plurality of ports 20 and 22 and filled with a vapor absorbing material such as a charcoal 24. The canister 18 is open at one end 26 thereof to atmosphere.

The valve 12 comprises a preferably plastic housing generally illustratred as 30. The housing 30 supports a solenoid assembly 32 comprising a plastic bobbin 34 which includes an inner, cylindrical wall 36. The bobbin further includes a spacer 38, plastic or ferro-magnetic, as the case may be, supported within the cylindrical wall 36 for dividing the interior of the cylindrical wall 36 into an upper chamber 40 and a lower chamber 42. Wound about the cylindrical wall 36 is an electric coil 44. The ends of the coil 44 are connected to an electrical connector 46 of known variety which is communicated to an electronic controlled unit (ECU) 48. As will be discussed in greater detail below the ECU 48 generates a variable duty cycle signal to selectively activate components of the valve 12. Positioned about the bobbin 34 is a ferro-magnetic strap or band 50 the purpose of which is to provide a preferred reluctance path for the magnetic flux generated upon activation the coil 44. The strap or band 50 includes an first opening 52 positioned at one end 54 of the bobbin 34 and a second opening 56 positioned at an opposing end 58 of the bobbin. The openings 52 and 56 are preferably coaxial with the interior of the cylindrical wall 36. Slidably received within the upper chamber 40 of the cylindrical wall 46 is a first piston or armature 60. The armature 60 includes a shoulder 62 proximate a lower end 64 thereof. A biasing spring 66 is positioned on one side of the spacer 38 in engagement with the shoulder 62 to urge the piston or armature 60 outwardly from the upper chamber 40. The piston 60 further includes a valve seating surface 68 positioned about its other end 70. In the embodiment illustrated in FIG. 1 the valve seating surface 68 is substantially flat. The valve seating surface 68 may be fabricated of rubber or the like.

Positioned within the solenoid assembly 32, opposite from the first piston or armature 60 is a second piston or armature 80. This armature 80 comprises a shoulder 82 proximate an end 84 thereof and a valve seating surface 86 proximate an opposite end 88. Another spring 90 is received between the lower side of the spacer 38 and the shoulder 82 for urging the second piston 80 outwardly from the lower chamber 42.

The valve 12 further includes a plurality of passages for communicating vacuum and hydrocarbons to and from the tank 14, vacuum manifold 16 and canister 18. More specifically the valve includes a vacuum port 100 at one end of a passage 102. The other end 104 of the passage 102 terminates at a valve seat 106 for receiving the valve seating surface 86 of the second armature 80. The end 104 of passage 102 extends within a first chamber 108. Extending from the chamber 108 is another passage 110 which terminates at a port 112 adapted to be connected by appropriate tubing 114 to one port such as port 22 of the canister 18. Communication between the intake manifold 16 and the canister 18 is controlled by displacing the armature 80 from the valve seat 106. Positioned opposite the vacuum port 100 is another port 120 adapted to communicate through tubing 122 with the fuel tank 14. The port 120 is located at one end 124 of a passage 126. The other end 128 of passage 186 is split, one end 130 of which extends axially downward toward the piston 60 and terminates at a valve seat 132 for receiving the valve seating surface 68. The valve seat 132 and valve seating surface 68 of the armature 60 are located within another chamber 134 which is communicated to the other port 20 of the canister 18 through a passage 136, a port 138, and tubing 140. The passage 126, at the split end thereof, communicates with passage 136 through a by-pass passage 142 which includes a valve seat 144 at one end thereof and a valve 146 biased into an engagement with the valve seat 144 by a spring 148. The purpose of the valve 146 is to control the level of vacuum pressure within the tank 14 wherein excess vacuum is vented to atmosphere through the canister 18. Such valve 46 may be referred to as a vacuum "blow-off" valve. As illustrated in the preferred embodiment of the invention shown in FIG. 2, a similar though oppositely responsive fuel tank pressure blow-off valve 172 may be incorporated within the invention. However, as can be seen from FIG. 1, an additional pressure blow-off valve is not a requirement of the invention in that the armature 60 and spring 66 can function as a pressure blow-off valve thereby automatically opening when the pressure in the fuel tank exceeds the spring pressure exerted by spring 66 on the armature 60 thereby releasing or venting excess pressure within the fuel tank to the canister 18.

The spring constant of spring 66 is preferably chosen to be less than the spring constant of spring 90. In operation such as at slow engine speeds the engine is not able to accept a high hydrocarbon purge flow rate from the canister 18; however, hydrocarbon vapors within the fuel tank can safely be transferred to the canister 18. During this operating condition the ECU 48 generates a relatively low duty cycle signal to the coil 44. Since the spring constant of spring 66 is less than the spring constant of spring 90 this low duty cycle signal is only sufficient to urge the armature 60 off from its valve seat thereby only permitting communication of hydrocarbons from the fuel tank 14 to the canister 18.

During engine operating conditions at high engine speeds both the flow rate of vapors from the fuel tank to the carbon canister 18 and the purge flow rate from the canister to the intake manifold can be at a higher level, as such the ECU 48 communicates a higher duty cycle signal to the coil 44, such signal sufficient to overcome the bias force generated by spring 90 thereby urging the piston 80 off from its valve seat 106 permitting communication from the canister 18 to the intake manifold. In as much as the spring constant of spring 66 is less than the spring constant of spring 90 this higher duty cycle signal will also urge the armature 60 off from its valve seat further permitting an increased rate of vapor flow from the fuel tank to the canister.

As such, it can be seen that the valve 12 regulates the pressure in the fuel tank, controls the rate at which hydrocarbon vapors are removed from the fuel tank and controls the rate of purging the hydrocarbon vapors from the canister 18 returning them into the intake manifold where they are combusted.

Figure 2:
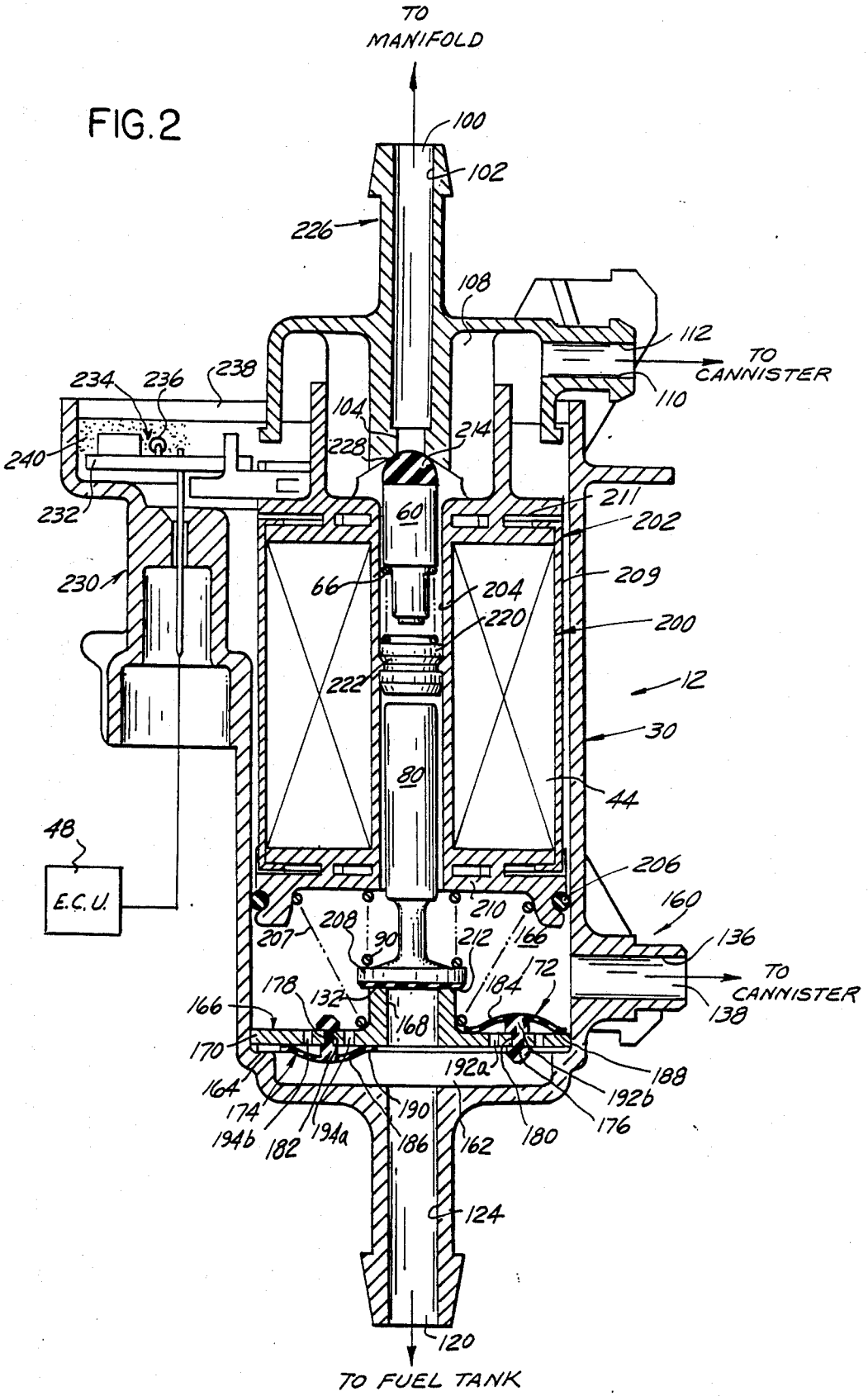
FIG. 2 illustrates the preferred embodiment of the present invention.

Reference is now made to FIG. 2 which illustrates a cross-sectional view of the preferred embodiment of the invention. Like structural components are described with numerals utilized in the description of FIG. 1. The valve 12 comprises a housing 30 which includes a lower member 160 having a port 120 communicated to the fuel tank. The port 120 is positioned at one end of a passage 124 which terminates at a chamber 162. The lower housing member 160 further includes a circumferential shoulder 164. Secured to the shoulder 164 is a valve support 166. The valve support 166 includes a passage 168 which may be coaxial with passage 124. The valve support 166 further includes a plate 170 disposed about passage 168 and which is supported by the shoulder 164. The plate 170 supports a plurality of valves such as 172 and 174. In the embodiment illustrated in FIG. 2, the valves 172 and 174 are umbrella valves each having a stem portion 176 and 178 respectively which are received through openings 180 and 182 within the plate 170. Each of the valves 172 and 174 include a flexible diaphragm portion or umbrella portion 184 and 186, each of which terminates at a circular end seal 188 and 190 which seals against the plate 170. The plate 170 further includes openings **192*a* and 192*b* and 194*a* and 194*b* positioned such that they are within the respective end seal 188 and 190 of the valves 172 and 174. The umbrella portion 184 of valve 172 is positioned on the upper side of the plate 170 and functions as a pressure blow off valve to vent excess fuel tank pressure to the canister 18. The other valve 174 functions as a fuel tank vacuum blow-off valve having its umbrella portion 186 positioned below the plate 170 such that it is urged from the plate 170** to relieve excess fuel tank vacuum.

The passage 168 of the valve support 166 terminates at the valve seat 132 which is positioned within chamber 66 which is communicated to the canister through passage 136 and port 138.

Positioned above the valve support 166 is a solenoid assembly 200 comprising a bobbin 202 having a central passage 204 about which is wound the coil 44. The bobbin 202 is sealed to the lower housing member 160 by an O-ring 206. The solenoid assembly is secured in place by a spring 207. A magnetic strap 209, similar in function to strap 50 (FIG. 1) may be fitted about the coil 44 and received in slots 211 of the bobbin 202.

Slidably positioned within the central passage 204 are the pistons 60 and 80. The piston 80 includes a flanged end 208 which receives the spring 90. The spring 90 is biased against a lower portion 210 of the bobbin 202. The flanged end 208 further includes a preferably resilient valve seating surface 212 for engagement with the valve seat 132. The other piston or armature 60 includes at one end thereof a preferably a spherical valve seating surface 214 which may be fabricated as a rubber insert attached or molded thereto. Positioned within the passage 204 is a ferro-magnetic stator generally illustrated as 220. The stator includes a ridged portion 222 secure within passage 204. The stator 220 may be press fit within the passage 204 or alternatively the bobbin may be insert molded about the stator 220. A spring 66 biases the piston 60 outwardly against the stator 220.

The housing 30 further includes an upper housing member generally designated as 226. The upper housing member 226 is joined to the lower housing member 160 thereby securing the bobbin 202 therein. The upper housing member 26 defines the vent port 100 at one end of passage 102 and another port 112 at the end of passage 110. The passage 110 terminates at a chamber 108 in a similar manner as illustrated in FIG. 1. The inner end 104 of passage 102 terminates at a preferably conically shaped valve seat 228 for receiving the preferably spherically shaped valve 214.

The ends of the coil 44 are communicated to the ECU 48 through a connector assembly 230. The connector assembly 230 may further include a circuit portion generally shown as 232 which houses an electrical circuit 234 which may comprise a diode 236 for controlling the collapse of the magnetic field in a known manner. The electric circuit 234 may be sealed to the lower housing member 160 by an end cap 238 and a potting material 240.

Many changes and modifications in the above described embodiment of the invention can of course be carrieid out without departing from the scope thereof. As an example, the umbrella valves 172 and 174 may be replaced by spring loaded valves. Accordingly, that scope is intended to be limited only my the scope of the appended claims.

We claim:

1. A hydrocarbon recovery and pressure control system comprising:

a valve adapted to communicate between a source of hydrocarbons, a hydrocarbon storage unit and a source of vacuum pressure, said valve responsive to and adapted to receive control signals and said valve comprising:

first passage means for communicating hydrocarbons from the source thereof to the storage unit, including a first valve seat;

second passage means for communicating hydrocarbons from the storage unit to the vacuum pressure source, including a second valve seat;

a solenoid assembly disposed between said first passage means and said second passage means; a central member, means for separating said central member into a first chamber proximate said first valve seat and a second chamber proximate said second valve seat, a first piston slidably received in said central member at said first chamber and first means for biasing said first piston into sealing engagement upon said first valve seat, a second piston slidably received in said central member, at said second chamber and second means for biasing said second piston into sealing engagement upon said second valve seat;

said first piston operable to move against the bias force generated by said first biasing means at a first value of said control signal to permit communication through said first valve seat; and said second piston operable to move against the bias force generated by said second biasing means at a second value of said control signal to permit communication through said second valve seat.

2. The system as defined in claim 1 wherein said first and second biasing means comprise first and second springs and wherein the spring constant of said first spring is less than the spring constant of said second spring.

3. The system as defined in claim 2 wherein said first and second pistons are axially aligned.

4. The system as defined in claim 2 wherein said first passage means includes a by-pass passage for communicating fluid about said first valve seat, a pressure responsive valve within said by-pass passage responsive to a pressure differential thereacross for opening and closing said by-pass passage.

5. The system as defined in claim 4 wherein said pressure responsive valve is operable to permit communication through said by-pass in response to a predetermined vacuum pressure differential.

6. The system as defined in claim 5 wherein said first piston is movable off from said first valve when the pressure thereacross exceeds a predetermined level.

7. The system as defined in claim 6 wherein said pressure responsive valve opens when the differential vacuum pressure between said hydrocarbon source and said storage unit exceeds said predetermined differential.

8. The system as defined in claim 1 wherein said means for separating includes a stator or core positioned within said central member.

9. The system as defined in claim 5 wherein said pressure responsive valve is an umbrella valve.

10. The system as defined in claim 5 further including another pressure responsive valve in said by-pass means for opening said by-pass means at a predetermined pressure level.

11. The system as defined in claim 1 wherein said source of hydrocarbons is a fuel take, said storage unit is a charcoal canister and said vacuum pressure source is engine intake manifold pressure.

* * * * *